US008626024B2

(12) United States Patent
Wu et al.

(10) Patent No.: US 8,626,024 B2
(45) Date of Patent: Jan. 7, 2014

(54) METHOD FOR CONTROLLING THE DISTANCE BETWEEN THE PHOTOSENSITIVE MEMBER AND THE DEVELOPING MEMBER IN A TONER CARTRIDGE, AND THE DEVICE THEREOF

(75) Inventors: Lianjun Wu, Guangdong (CN); Qingfei Peng, Guangdong (CN); Jianxin Cao, Guangdong (CN)

(73) Assignee: Zhuhai Seine Technology Limited, Zhuhai (CN)

( * ) Notice: Subject to any disclaimer, the term of this patent is extended or adjusted under 35 U.S.C. 154(b) by 268 days.

(21) Appl. No.: 12/541,921

(22) Filed: Aug. 15, 2009

(65) Prior Publication Data

US 2010/0040392 A1 Feb. 18, 2010

(30) Foreign Application Priority Data

Aug. 15, 2008 (CN) ..... 2008 1 0141943

(51) Int. Cl.
*G03G 21/16* (2006.01)

(52) U.S. Cl.
USPC ..... 399/111; 399/119

(58) Field of Classification Search
USPC ..... 399/111, 119
See application file for complete search history.

(56) References Cited

U.S. PATENT DOCUMENTS

| | | | | |
|---|---|---|---|---|
| 5,089,849 | A * | 2/1992 | Hiraoka | 399/119 |
| 5,212,520 | A * | 5/1993 | Toyofuku | 399/107 |
| 5,648,839 | A * | 7/1997 | Koshino et al. | 399/271 |
| 5,669,042 | A * | 9/1997 | Kobayashi et al. | 399/111 |
| 6,101,350 | A * | 8/2000 | Suzuki et al. | 399/113 |
| 6,397,026 | B1 * | 5/2002 | Buxton et al. | 399/111 |
| 6,542,706 | B2 * | 4/2003 | Toba et al. | 399/111 |
| 6,714,746 | B2 * | 3/2004 | Morioka et al. | 399/27 |
| 7,386,254 | B2 * | 6/2008 | Okoshi | 399/113 |
| 7,729,637 | B2 * | 6/2010 | Sato | 399/111 |
| 7,761,025 | B2 * | 7/2010 | Sato | 399/90 |
| 2002/0071693 | A1 * | 6/2002 | Shimaoka | 399/113 |
| 2003/0142991 | A1 * | 7/2003 | Arimitsu et al. | 399/90 |
| 2005/0053394 | A1 * | 3/2005 | Ishii et al. | 399/111 |
| 2007/0036580 | A1 * | 2/2007 | Noh | 399/111 |
| 2010/0202796 | A1 * | 8/2010 | Ooyoshi et al. | 399/111 |

* cited by examiner

*Primary Examiner* — G. M. Hyder

(74) *Attorney, Agent, or Firm* — Jackson IPG PLLC

(57) ABSTRACT

A method for controlling a distance between a photosensitive member and a developing member in an integral or separated toner cartridge. The toner cartridge is provided with an elastic member for providing an elastic force to the developing member or to the photosensitive member, so as to force the developing member to move towards the photosensitive member, or to force the photosensitive member to move towards the developing member. A production accuracy requirement of the toner cartridge is reduced by the elasticity of the elastic member. Also a device for controlling a distance between a photosensitive member and a developing member in a toner cartridge. By using the method and the device thereof, the requirement of the manufacturing accuracy of a toner cartridge can be reduced, and the negative impact of the accuracy bias caused by abrasion can be reduced, so, the product cost is saved, and the service life of the product is increased.

12 Claims, 13 Drawing Sheets

METHOD FOR CONTROLLING THE DISTANCE BETWEEN THE PHOTOSENSITIVE MEMBER AND THE DEVELOPING MEMBER IN A TONER CARTRIDGE, AND THE DEVICE THEREOF

BACKGROUND OF THE INVENTION

1. Field of the Invention

The present invention involves an electrophotographic image forming device, and especially involves a toner cartridge for an electrophotographic image forming device.

2. Description of the Related Arts

The conventional invention relates to an electrophotographic image forming device, such as a laser printer, a copier or a facsimile machine, in which a toner cartridge is used, which is removable from or mountable to the electrophotographic image forming device.

Conventional toner cartridge comprises integral toner cartridges and separated toner cartridges. An integral toner cartridge or process cartridge is at least provided with a photosensitive member, a developing member, and a developer; a separated toner cartridge is at least provided with a developing member and a developer, and the drum unit used together with the separated toner cartridge is at least provided with a photosensitive member.

FIG. 1 is a front view of a process cartridge in conventional art, which adopts contact developing mode. The process cartridge comprises a main part 10, a first lateral plate 11, and a second lateral plate 12; the first lateral plate 11 and the second lateral plate 12 are separately fixed at the two ends of the main part 10; the first lateral plate 11 and the second lateral plate 12 are removable from or mountable to the two ends of the main part 10, or form as one body with the main part 10.

FIG. 2 is a sectional view of the direction A-A in FIG. 1; as shown in the figure, the main part 10 of the process cartridge is at least provided with the first embodiment of photosensitive member 13, the first embodiment of developing member 14, a toner feeding component 15, and a developer (not shown in the figure). After the process cartridge is mounted to an electrophotographic image forming device, the electrophotographic image forming device receives the data from the outside; the laser scanning component of the electrophotographic image forming device scans the first embodiment of photosensitive member 13 of the process cartridge, so as to make an electrostatic latent image to be formed on the first embodiment of photosensitive member 13; the toner feeding component 15 receives the power and electric voltage from the electrophotographic image forming device, and feeds the developer stored in the process cartridge to the first embodiment of developing member 14; with the power and electric voltage provided by the electrophotographic image forming device, the developer is adsorbed to the surface of the first embodiment of developing member 14; by contacting the first embodiment of photosensitive member 13 closely, the first embodiment of developing member 14 transports the developer to the first embodiment of photosensitive member 13, and makes the electrostatic latent image on the photosensitive member developed.

As shown in FIG. 3 and FIG. 4, the first lateral plate 11 and the second lateral plate 12 are respectively provided with the photosensitive member fixing positions 23*a*, 23*b*, the developing member fixing positions 24*a*, 24*b*, and the process feeding component fixing positions 25*a*, 25*b*.

The first embodiment of photosensitive member 13, the first embodiment of developing member 14, and the toner feeding component 15 are respectively fixed to the process cartridge via the photosensitive member fixing positions 23*a*, 23*b*, the developing member fixing positions 24*a*, 24*b*, and the toner feeding component fixing positions 25*a*, 25*b* on the first lateral plate 11 and the second lateral plate 12. For the distances between the photosensitive member fixing positions 23*a*, 23*b*, the developing member fixing positions 24*a*, 24*b*, and the toner feeding component fixing positions 25*a*, 25*b* have been determined when the first lateral plate 11 and the second lateral plate 12 are made, the center distances between the first embodiment of photosensitive member 13, the first embodiment of developing member 14, and the toner feeding component 15 have been set as fixed values. The manufacturing accuracy of the fixing positions (23*a*, 23*b*, 24*a*, 24*b*, 25*a*, 25*b*) for positioning the first embodiment of photosensitive member 13 and the first embodiment of developing member 14 on the first lateral plate 11 and the second lateral plate 12 directly affects the working quality of the first embodiment of photosensitive member 13 and the first embodiment of developing member 14, therefore affect the working quality of the electrophotographic image forming device; any small error that occurs to manufacture the fixing positions for positioning the first embodiment of photosensitive member 13 and the first embodiment of developing member 14 on the first lateral plate 11 and the second lateral plate 12, will all affect the working quality of the process cartridge, and serious error will even cause that the process cartridge can not operate properly. So, the requirement to the manufacturing accuracy of the first lateral plate 11 and the second lateral plate 12 will be very high.

FIG. 5 is a front view of another kind of process cartridge in conventional art, which adopts non-contact developing mode. FIG. 6 is a sectional view of the direction B-B in FIG. 5; FIG. 7 and FIG. 8 are respectively schematic diagrams of the two ends of the process cartridge.

As shown in FIGS. 5-8, the process cartridge comprises a main part 30, a first lateral plate 31, and a second lateral plate 32; the first lateral plate 31 and the second lateral plate 32 are respectively mounted at the two ends of the main part 30; the first lateral plate 31 and the second lateral plate 32 are removable from or mountable to the two ends of the main part 30, or form as one body with the main part 30.

The main part 30 of the process cartridge is at least provided with the second embodiment of photosensitive member 33, the second embodiment of developing member 34, and a developer (not shown in the figure). The working principle of the process cartridge is the same with the working principle of the process cartridge shown in FIG. 1. Specially, the second embodiment of photosensitive member 33 is one of the organic photosensitive drums; the second embodiment of developing member 34 is one of the magnetic rollers, and the magnetic roller is composed of a magnetic core and a magnetic sleeve; the developer is a kind of magnetic toner.

The first lateral plate 31 is provided with a photosensitive member fixing position 43*a* and a developing member fixing position; the second lateral plate 32 is provided with a photosensitive member fixing position 43*b* and a developing member fixing position 44*b*.

The second embodiment of photosensitive member 33 and the second embodiment of developing member 34 of the process cartridge are respectively fixed to the process cartridge via the photosensitive member fixing positions 43*a*, 43*b* and the developing member fixing position 44*b* on the first lateral plate 31 and the second lateral plate 32. To make an electrophotographic image forming device work well during the working process, the second embodiment of photosensitive member 33 and the second embodiment of developing member 34 of the process cartridge are required to keep the clearance between them for a certain magnitude, and the magnitude of the clearance is a constant value; so, the distance between the photosensitive member fixing positions 43*a*, 43*b* and the developing member fixing position 44*b* on the first lateral plate 31 and the second lateral plate 32 is required to be a constant value, and it is required to be changeless during the working process. So, the manufacturing accuracy of the fixing positions (43*a*, 43*b*, 44*b*) on the first lateral plate 31 and the second lateral plate 32 directly affects the magnitude of the clearance between the second embodiment of photosensitive member 33 and the second embodiment of developing member 34 of the process cartridge, and also affects the working quality of the process cartridge. The errors that occur during manufacturing the first lateral plate 31 and the second lateral plate 32, will affect the working quality of the process cartridge and the electrophotographic image forming device; so, the requirement of the manufacturing accuracy of the first lateral plate 31 and the second lateral plate 32 is very high.

As known above mentioned two conventional techniques, the requirement of the manufacturing accuracy of the first lateral plate 11 or 31 and the second lateral plate 12 or 32 of the process cartridge is very high, and any small error that occurs as manufacturing will cause that the process cartridge can not operate properly. The high accuracy requirement of the first lateral plate 11 or 31 and the second lateral plate 12 or 32 of the process cartridge causes that the product is hard to be manufactured, and the production cost is accordingly increased. At the same time, because after the fixing positions (23*a*, 23*b*, 24*a*, 24*b*, or 43*a*, 43*b*, 44*b*) of the first lateral plate 11 or 31 and the second lateral plate 12 or 32 are rubbed out by the first embodiment of photosensitive member 13 or 33 and the first embodiment of developing member 14 or 34 for a long time, they can't not meet the using requirement; it is hard to ensure the electrophotographic image forming device to operate properly, and the service life of the process cartridge is decreased.

SUMMARY OF THE INVENTION

The present invention provides the following methods and devices for controlling the distance between the photosensitive member and the developing member of a process cartridge, so as to solve the problems that: when the photosensitive member and the developing member of conventional process cartridges are rubbed out for a long time, they can't not meet the using requirement; it is hard to ensure the electrophotographic image forming device to operate properly, and the service life of the process cartridge is decreased.

To solve above mentioned problems, the present invention provides the following solutions.

A method for controlling the distance between the photosensitive member and the developing member in a process cartridge, wherein an elastic member providing an elastic force to the developing member is mounted in the process cartridge, so as to force the developing member to move towards the photosensitive member; the elastic member is mounted on a main part, a first lateral plate, or a second lateral plate of the process cartridge, and the developing member is movable relative to the main part of the process cartridge.

Another method for controlling the distance between the photosensitive member and the developing member in a process cartridge, wherein an elastic member providing an elastic force to the photosensitive member is mounted in the process cartridge, so as to force the photosensitive member to move towards the developing member; the elastic member is mounted on a main part, a first lateral plate, or a second lateral plate of the process cartridge, and the photosensitive member is movable relative to the main part; the elastic member is mounted on the main part to provide the elastic force via a photosensitive member frame.

A first device for controlling the distance between the photosensitive member and the developing member in a process cartridge, comprises a main part, a photosensitive member, and a developing member, wherein it also comprises an elastic member providing an elastic force to the developing member, so as to force the developing member to move towards the photosensitive member; it also comprises a main part, a first lateral plate, and a second lateral plate; the first and the second lateral plates are located at the two sides of the main part to support the developing member, and the developing member is movable relative to the main part; the elastic member is mounted on the main part, the first lateral plate, or the second lateral plate.

A second device for controlling the distance between the photosensitive member and the developing member in a process cartridge, comprises a photosensitive member and a developing member, wherein it also comprises an elastic member providing an elastic force to the photosensitive member, so as to force the photosensitive member to move towards the developing member. It also comprises a main part, a first lateral plate, and a second lateral plate; the first and the second lateral plates are located at the two sides of the main part to support the photosensitive member, and the photosensitive member is movable relative to the main part; the elastic member is mounted on the main part, the first lateral plate, or the second lateral plate. It also comprises a photosensitive member frame; the photosensitive member frame is used to support the photosensitive member; the photosensitive member frame is movable relative to the main part; the elastic member provides the elastic force to the photosensitive member via the photosensitive member frame.

A third device for controlling the distance between the photosensitive member and the developing member in a toner cartridge, comprises a separated toner cartridge being used together with a drum unit; the separated toner cartridge includes a separated main part of the separated toner cartridge, a first side of the separated toner cartridge, a second side of the separated toner cartridge, and a developing member; the developing member is supported on the first side and the second side of the separated toner cartridge; wherein the separated toner cartridge is provided with an elastic member, and the elastic member is used to provide an elastic force to the developing member, so as to force the developing member to move towards a photosensitive member of the drum unit. The developing member is movable relative to the separated main part; the elastic member is mounted on the main part, the first side, or the second side.

A fourth device for controlling the distance between the photosensitive member and the developing member in a toner cartridge, comprises a drum unit being used together with a separated toner cartridge; the drum unit includes a drum unit main part, a first side of the drum unit, a second side of the drum unit, and a photosensitive member; the photosensitive member is supported on the first side and the second side of the drum unit; wherein the drum unit is provided with an elastic member, and the elastic member is used to provide an elastic force to the photosensitive member, so as to force the photosensitive member to move towards a developing member of the separated toner cartridge. The photosensitive member is movable relative to the drum unit main part; the elastic member is mounted on the main part, the first side, or the second side. It also comprises a photosensitive member frame; the photosensitive member frame is used to support the photosensitive member; the photosensitive member frame is movable relative to the drum unit main part; the elastic member provides the elastic force to the photosensitive member via the photosensitive member frame.

After adopting the above mentioned technical solutions, for the toner cartridge is separately provided with an elastic member for providing an elastic force to the developing member or to the photosensitive member, so as to force the developing member to move towards the photosensitive member, or to force the photosensitive member to move towards the developing member; the distance between the photosensitive member and the developing member is adjusted via the elastic force provided by the elastic member, so, the production accuracy requirement and the production cost of the toner cartridge are all reduced greatly, and the technical problems that are hard to overcome in batch production are solved.

DESCRIPTION OF THE PREFERRED EMBODIMENT

Embodiment 1

Figure 1:
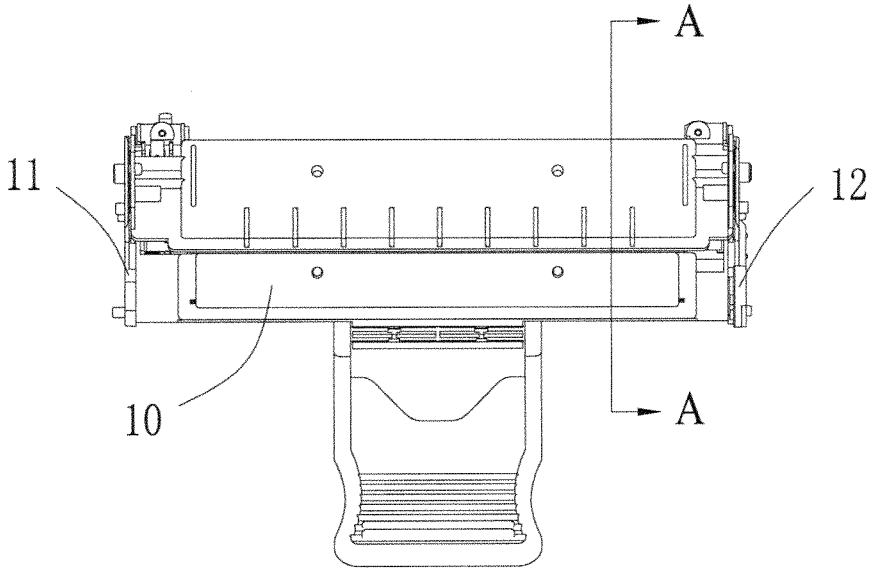
FIG. 1 is a top view of an integral toner cartridge or process cartridge in conventional art.
Figure 2:
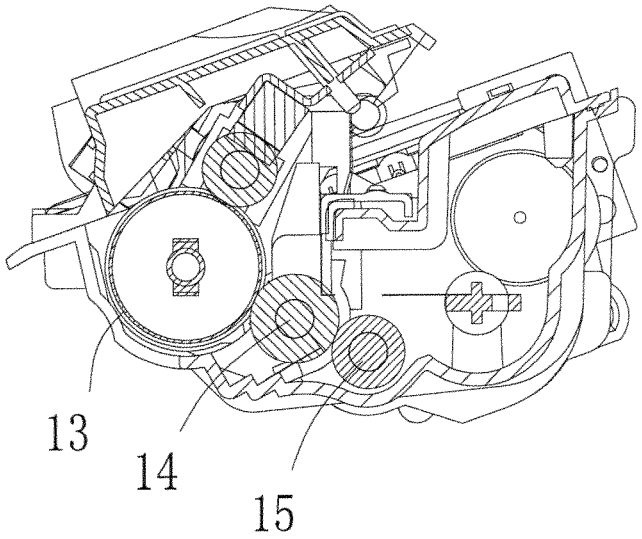
FIG. 2 is a sectional view of the direction A-A in FIG. 1.
Figure 3:
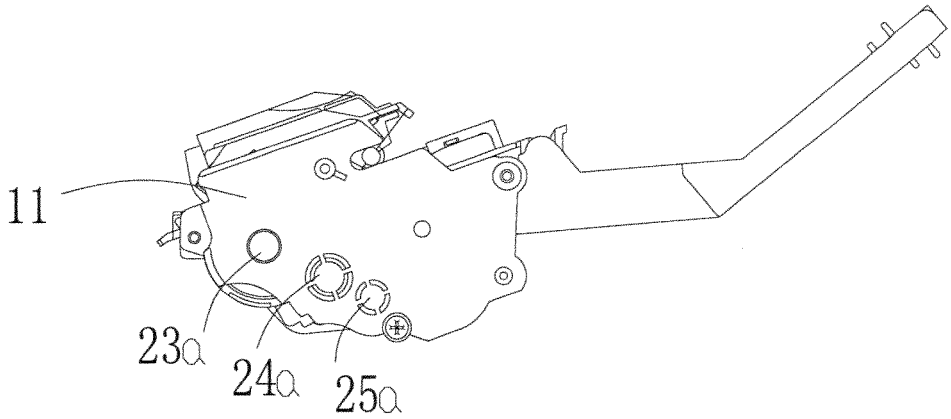
FIG. 3 and FIG. 4 are respectively the left view and the right view of the integral toner cartridge in conventional art shown in FIG. 1.
Figure 4:
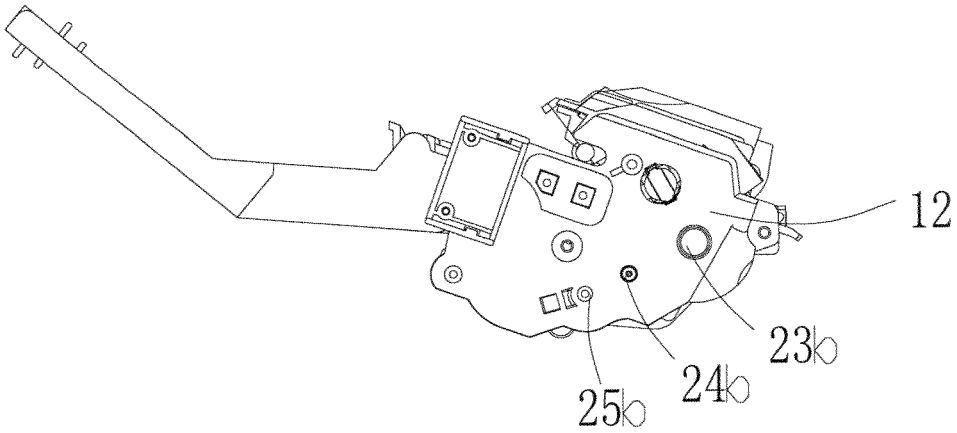

In the present embodiment, except for the special explanation, the structure of the process cartridge is the same with the structure of the process cartridge as shown in FIG. 1.

Figure 9:
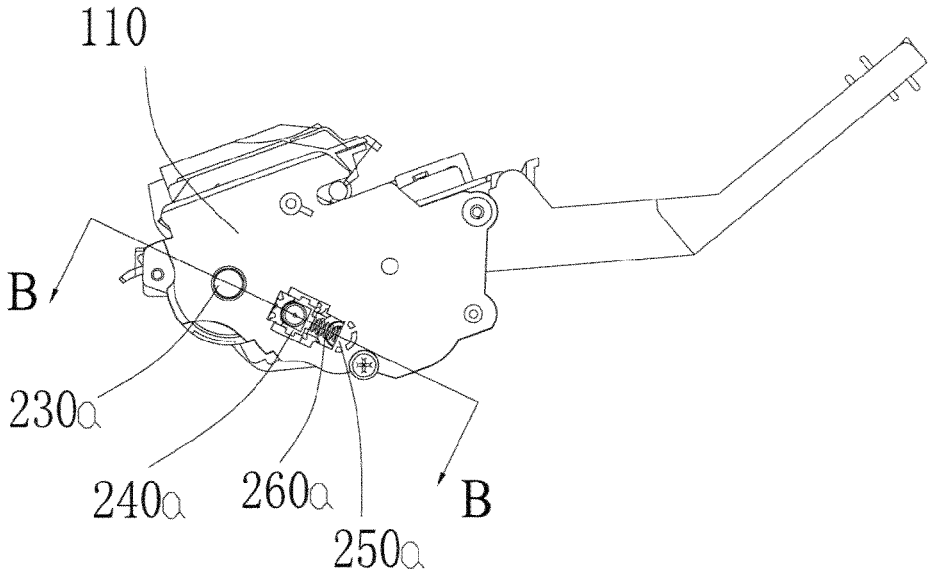
FIG. 9 and FIG. 10 are the left view and the right view of the process cartridge of the first embodiment of the present invention.
Figure 10:
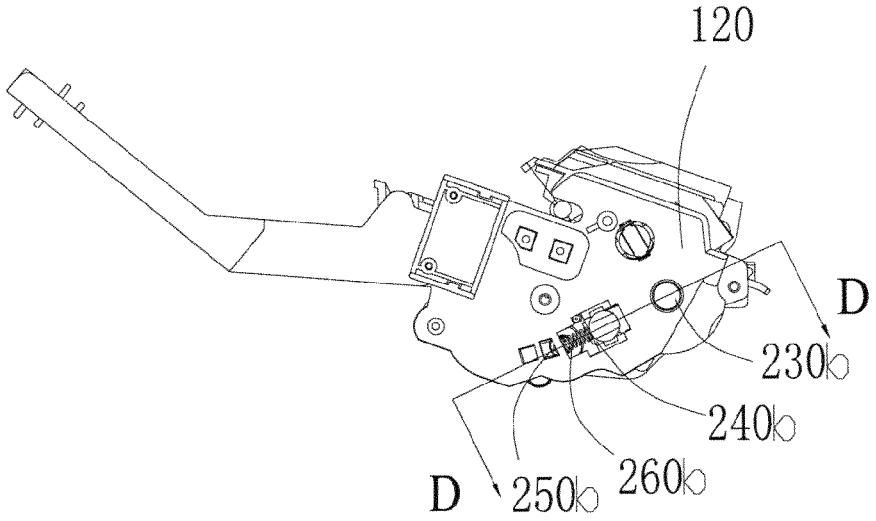

Referring to FIG. 9 and FIG. 10, the process cartridge comprises a main part 10, a first lateral plate 110, and a second lateral plate 120; the first lateral plate 110 and the second lateral plate 120 are both mounted on the main part 10. The main part 10 comprises a first embodiment of photosensitive member 13, a first embodiment of developing member 14, a toner feeding component 15, and a developer (not shown in the figure); the first embodiment of photosensitive member 13, the first embodiment of developing member 14, and the toner feeding component 15 are all located between the first lateral plate 110 and the second lateral plate 120. As shown in FIG. 9 and FIG. 10, the first lateral plate 110 and the second lateral plate 120 are respectively provided with photosensitive member fixing positions 230*a*, 230*b*, a first supporting component 240*a*, a second supporting component 240*b*, a first elastic member 260*a*, a second elastic member 260*b*, and toner feeding component fixing positions 250*a*, 250*b*.

The relative positions of the photosensitive member fixing positions 230*a*, 230*b* and the toner feeding component fixing positions 250*a*, 250*b* keep unchanged all along during the working process of the electrophotographic image forming device. The first embodiment of photosensitive member 13 is fixed to the first lateral plate 110 and the second lateral plate 120 via the photosensitive member fixing positions 230*a*, 230*b* on the first lateral plate 110 and the second lateral plate 120; the toner feeding component 15 is fixed to the first lateral plate 110 and the second lateral plate 120 via the toner feeding component fixing positions 250*a*, 250*b*. So, the positions of the first embodiment of photosensitive member 13 and the toner feeding component 15 keep unchanged all along relative to the main part 10.

The first embodiment of developing member 14 is supported on the first lateral plate 110 and the second lateral plate 120 respectively by the first supporting component 240*a* and the second supporting component 240*b* on the first lateral plate 110 and the second lateral plate 120; the first supporting component 240*a* and the second supporting component 240*b* can slide freely on the first lateral plate 110 and the second lateral plate 120; the first elastic member 260*a* and the second elastic member 260*b* respectively apply elastic forces to the first supporting component 240*a* and the second supporting component 240*b*, and the direction of the elastic forces is along the direction of the connection line of the axis of the first embodiment of photosensitive member 13 and the axis of the first embodiment of developing member 14, pointing to the first embodiment of photosensitive member 13. The first embodiment of developing member 14 can slide relative to the main part 10 along the direction of the connection line of the axis of the first embodiment of photosensitive member 13 and the axis of the first embodiment of developing member 14.

Figure 11:
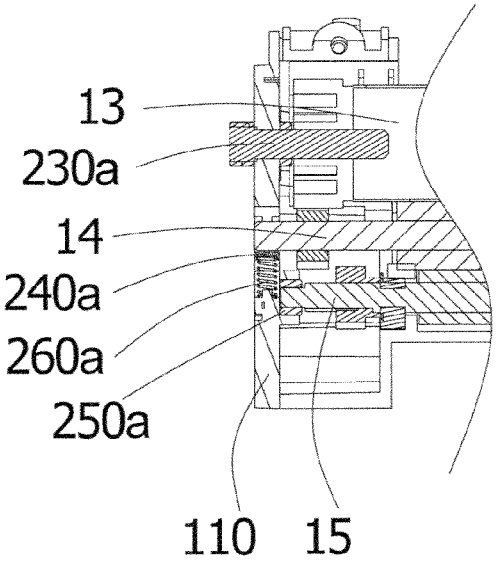
FIG. 11 is a sectional view of the direction C-C in FIG. 9.
Figure 12:
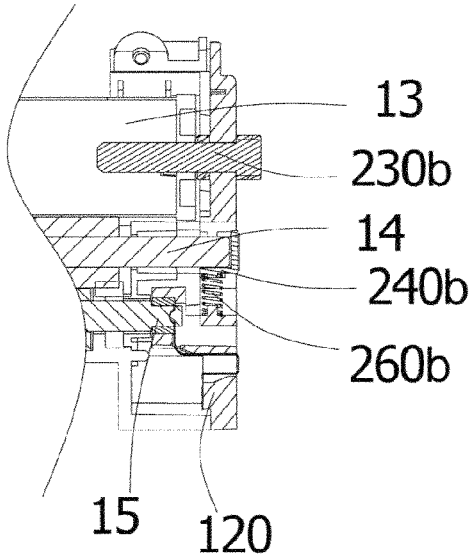
FIG. 12 is a sectional view of the direction D-D in FIG. 10.

FIG. 11 is a sectional view of the direction C-C in FIG. 9, and FIG. 12 is a sectional view of the direction D-D in FIG. 10. As shown in FIG. 11, the first supporting component 240*a* and the first elastic member 260*a* are located at the positions away from the first embodiment of photosensitive member 13 relative to the first embodiment of developing member 14 first embodiment of developing member 14; the first supporting component 240*a* supports the first embodiment of developing member 14; the first elastic member 260*a* applies an elastic force to the first supporting component 240*a* to make that the first embodiment of developing member 14 can move along the direction of the connection line of the axis of the first embodiment of photosensitive member 13 and the axis of the first embodiment of developing member 14, so as to move towards the first embodiment of photosensitive member 13 relative to the main part 10; the elastic force makes the first embodiment of photosensitive member 13 to closely contact the first embodiment of developing member 14, and adjusts the magnitude of interference between the first embodiment of photosensitive member 13 and the first embodiment of developing member 14.

In the same way, as shown in FIG. 12, the second supporting component 240*b* and the second elastic member 260*b* are located at the positions away from the first embodiment of photosensitive member 13 relative to the first embodiment of developing member 14; an elastic force is applied to the first embodiment of developing member 14 to make the first embodiment of developing member 14 move towards the first embodiment of photosensitive member 13, so as to make the first embodiment of photosensitive member 13 to closely contact the first embodiment of developing member 14; and the elastic force adjusts the magnitude of interference between the first embodiment of photosensitive member 13 and the first embodiment of developing member 14.

In particular, the first elastic member 260*a* and the second elastic member 260*b* are one kind of compression springs, and the elastic force is an elastic thrust.

Selectively, the first elastic member 260*a*, the second elastic member 260*b*, the first supporting component 240*a*, and the second supporting component 240*b* can also be located at the two sides of the main part 10, so as to support the first embodiment of developing member 14 and apply an elastic force to it.

Selectively, the first elastic member 260*a*, the second elastic member 260*b*, the first supporting component 240*a*, and the second supporting component 240*b* can also be located between the first embodiment of developing member 14 and the first embodiment of photosensitive member 13; the first elastic member 260*a* and the second elastic member 260*b* are one kind of elastic extension springs; the first elastic member 260*a* and the second elastic member 260*b* apply elastic forces to the first embodiment of developing member 14 via the first supporting component 240*a* and the second supporting component 240*b*, and the direction of the elastic forces is along the direction of the connection line of the axis of the first embodiment of photosensitive member 13 and the axis of the first embodiment of developing member 14, pointing to the first embodiment of photosensitive member 13, so as to make the first embodiment of developing member 14 to move towards the first embodiment of photosensitive member 13.

Embodiment 2

Figure 5:
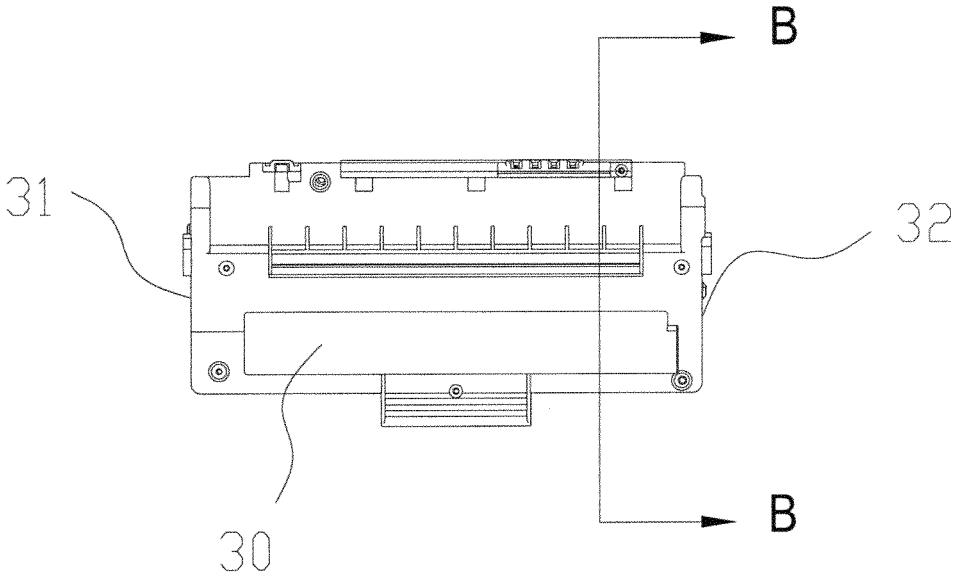
FIG. 5 is a top view of another kind of process cartridge in conventional art.
Figure 6:
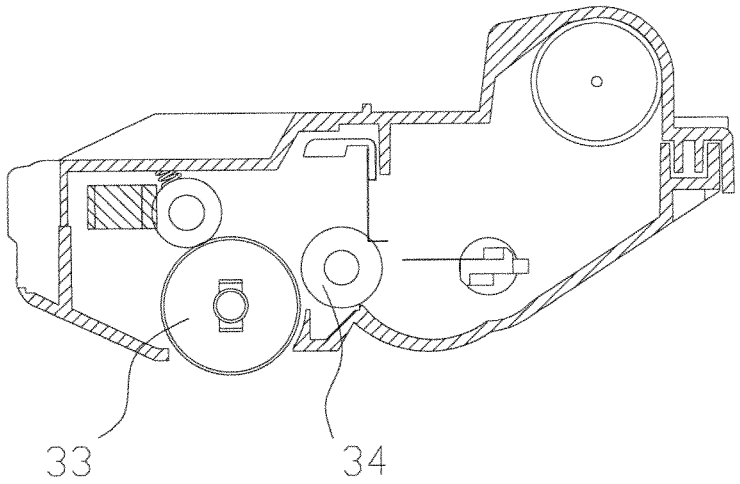
FIG. 6 is a sectional view of the direction B-B in FIG. 5.
Figure 7:
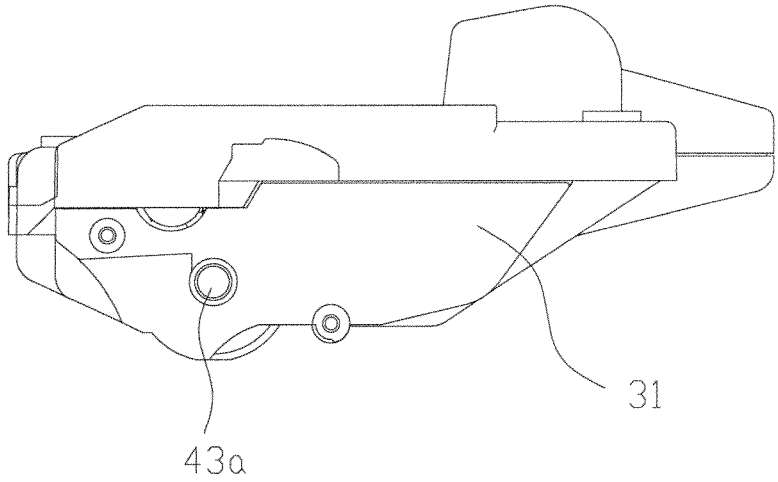
FIG. 7 and FIG. 8 are respectively the left view and the right view of another kind of process cartridge in conventional art shown in FIG. 5.
Figure 8:
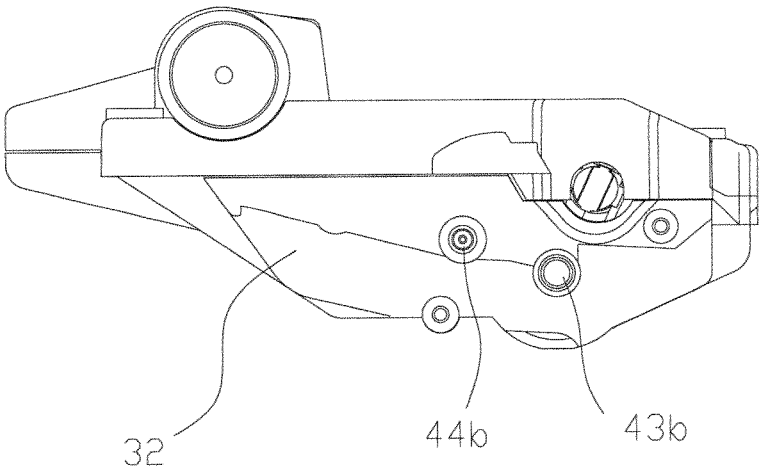

In the present embodiment, except for the special explanation, the structure of the process cartridge is the same with the structure of the process cartridge as shown in FIG. 5.

Figure 13:
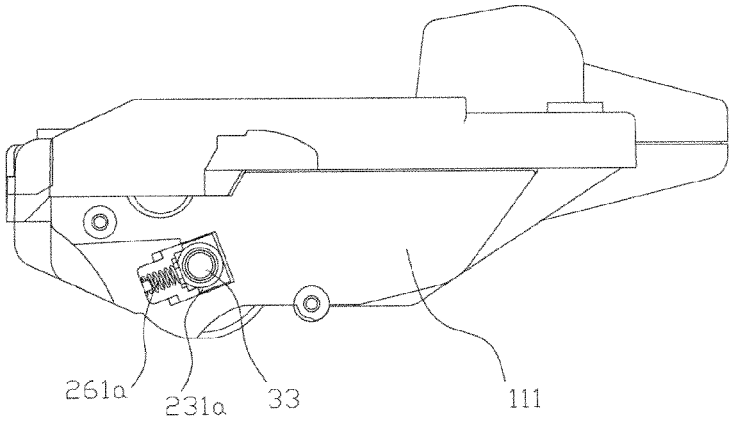
FIG. 13 and FIG. 14 are the left view and the right view of the process cartridge of the second embodiment of the present invention.
Figure 14:
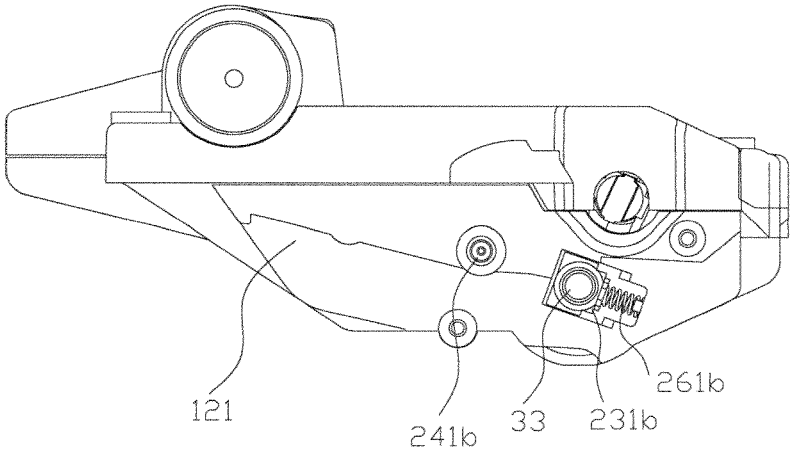

Referring to FIG. 13 and FIG. 14, the process cartridge comprises a main part 30, a first lateral plate 111, and a second lateral plate 121; the first lateral plate 111 and the second lateral plate 121 are both mounted on the main part 30. The main part 30 comprises a second embodiment of photosensitive member 33, the second embodiment of developing member 34, and a developer (not shown in the figure); the second embodiment of photosensitive member 33 and the second embodiment of developing member 34 are located between the first lateral plate 111 and the second lateral plate 121. The first lateral plate 111 is provided with a first elastic member 261*a*, a first supporting component 231*a*, and a developing member fixing position (not shown in the figure); the second lateral plate 121 is provided with a second elastic member 261*b*, a second supporting component 231*b*, and a developing member fixing position (not shown in the figure). The two ends of the second embodiment of photosensitive member 33 are respectively supported by the first supporting component 231*a* and the second supporting component 231*b*; the first supporting component 231*a* and the second supporting component 231*b* can slide freely on the first lateral plate 111 and the second lateral plate 121; the second embodiment of photosensitive member 33 can slide freely relative to the main part 30; the two ends of the second embodiment of developing member 34 are respectively fixed on the developing member fixing positions 241*a*, 241*b*, and the second embodiment of developing member 34 can not move freely relative to the main part 30.

As shown in the figures, the first elastic member 261*a* and the second elastic member 261*b* are respectively located at the positions away from the second embodiment of developing member 34 relative to the second embodiment of photosensitive member 33; elastic forces are respectively applied to the two ends of the second embodiment of photosensitive member 33 via the first supporting component 231*a* and the second supporting component 231*b*; the direction of the elastic forces is along the direction of the connection line of the axis of the second embodiment of photosensitive member 33 and the axis of the second embodiment of developing member 34, pointing to the second embodiment of developing member 34; the elastic forces make the second embodiment of photosensitive member 33 to move towards the second embodiment of developing member 34 relative to the main part 30; the elastic forces make the second embodiment of photosensitive member 33 and the second embodiment of developing member 34 to keep a certain clearance magnitude, and the clearance magnitude between the second embodiment of photosensitive member 33 and the second embodiment of developing member 34 is adjusted by the elastic forces.

In particular, the first elastic member 261*a* and the second elastic member 261*b* are one kind of compression springs, and the elastic force is an elastic thrust.

Selectively, the first elastic member 261*a*, the second elastic member 261*b*, the first supporting component 241*a*, and the second supporting component 241*b* can also be located at the two sides of the main part 30, so as to support the second embodiment of developing member 34 and apply an elastic force to it.

Selectively, the first elastic member 261*a*, the second elastic member 261*b*, the first supporting component 241*a*, and the second supporting component 241*b* can also be located between the second embodiment of developing member 34 and the second embodiment of photosensitive member 33; the first elastic member 261*a* and the second elastic member 261*b* are one kind of elastic extension springs; the first elastic member 261*a* and the second elastic member 261*b* apply elastic forces to the second embodiment of developing member 34 via the first supporting component 241*a* and the second supporting component 241*b*, and the direction of the elastic forces is along the direction of the connection line of the axis of the second embodiment of photosensitive member 33 and the axis of the second embodiment of developing member 34, pointing to the second embodiment of photosensitive member 33, so as to make the second embodiment of developing member 34 to move towards the second embodiment of photosensitive member 33.

Embodiment 3

Figure 15:
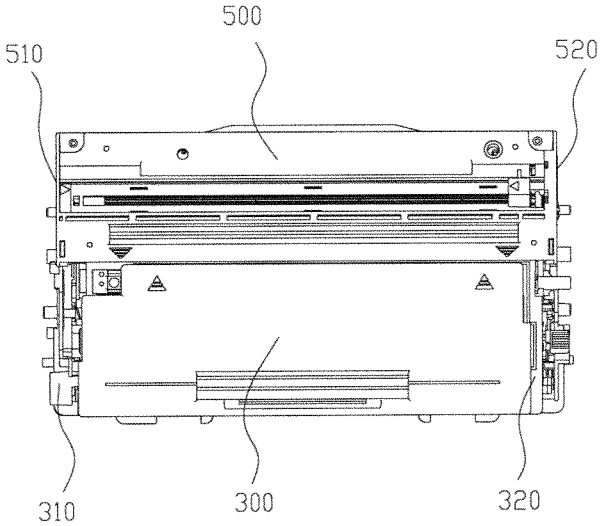
FIG. 15 illustrates a separated toner cartridge and a drum unit of the third embodiment of the present invention.

FIG. 15 illustrates a separated toner cartridge and a drum unit used together with the separated toner cartridge, and the separated toner cartridge and the drum unit adopt contact developing mode. The separated toner cartridge comprises a separated main part 300, a first side 310 and a second side 320 of the separated toner cartridge; the drum unit comprises a drum unit main part 500, a first side 510 and a second side 520 of the drum unit.

Figure 17:
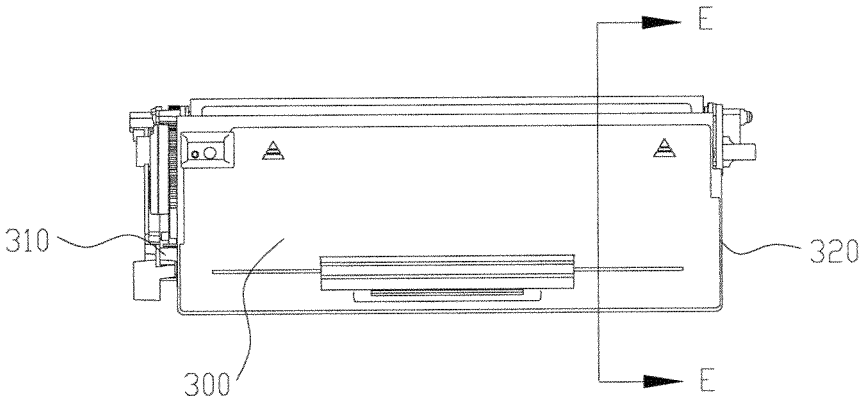
FIG. 17 is a top view of the separated toner cartridge of the third embodiment of the present invention.
Figure 21:
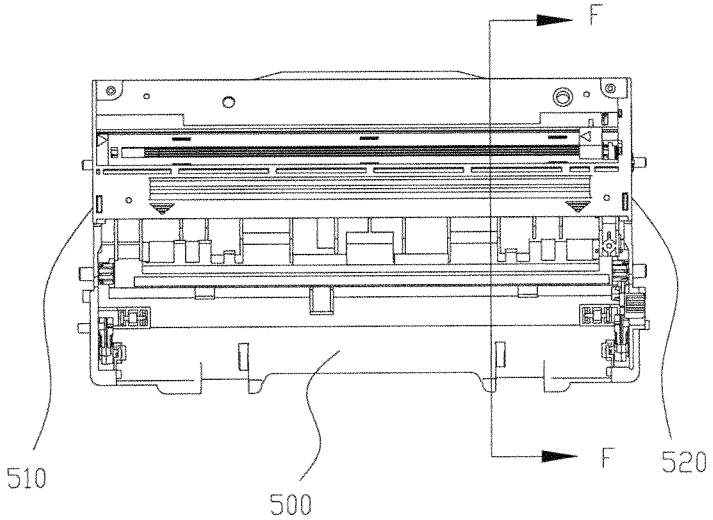
FIG. 21 is a top view of the drum unit of the third embodiment of the present invention.

As shown in FIG. 17, the first side 310 and the second side 320 of the separated toner cartridge are respectively located at the two ends of the toner cartridge, and form as one body with the separated main part 300; as shown in FIG. 21, the first side 510 and the second side 520 of the of the drum unit are located at the two ends of the main part 500 of the drum unit, and form as one body with the main part 500 of the drum unit.

Figure 16:
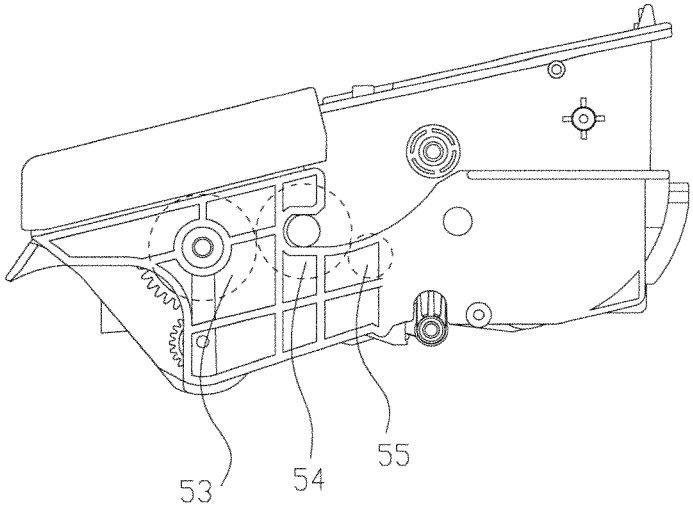
FIG. 16 is a left view of the separated toner cartridge and the drum unit of the third embodiment of the present invention.
Figure 18:
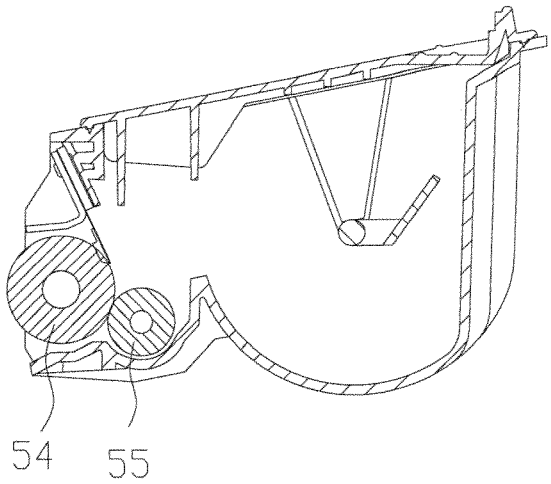
FIG. 18 is a sectional view of the direction E-E in FIG. 17.
Figure 22:
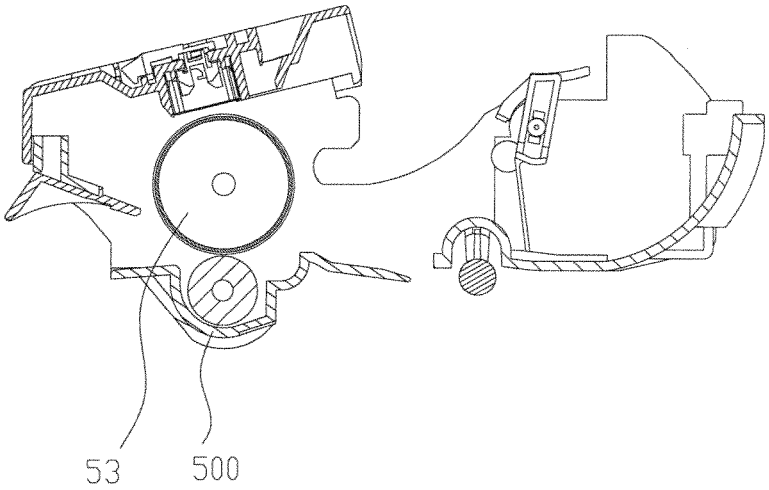
FIG. 22 is a sectional view of the direction F-F in FIG. 21.

As shown in FIG. 16, FIG. 18, and FIG. 22, the main part 500 of the drum unit contains a third embodiment of photosensitive member 53; the third embodiment of photosensitive member 53 is located between the first side 510 and the second side 520 of the drum unit, which is fixed and not movable; the main part 300 of the separated toner cartridge contains a third embodiment of developing member 54, a toner feeding component 55, and a developer (not shown in the figure); the third embodiment of developing member 54 and the toner feeding component 55 are located between the first side 310 and the second side 320 of the separated toner cartridge.

Figure 19:
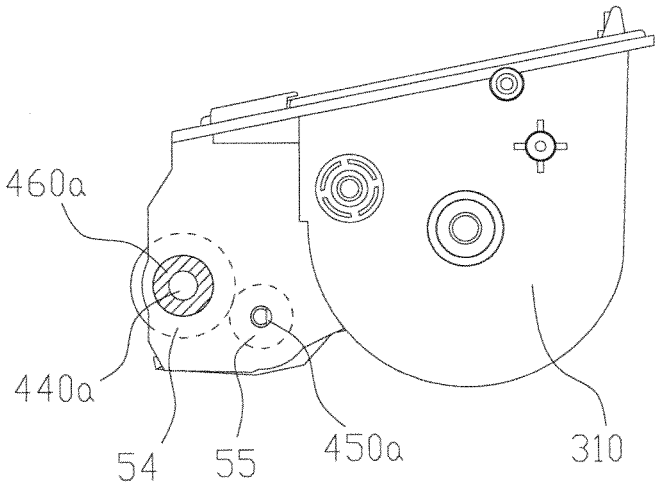
FIG. 19 and FIG. 20 are the left view and the right view of the separated toner cartridge of the third embodiment of the present invention.
Figure 20:
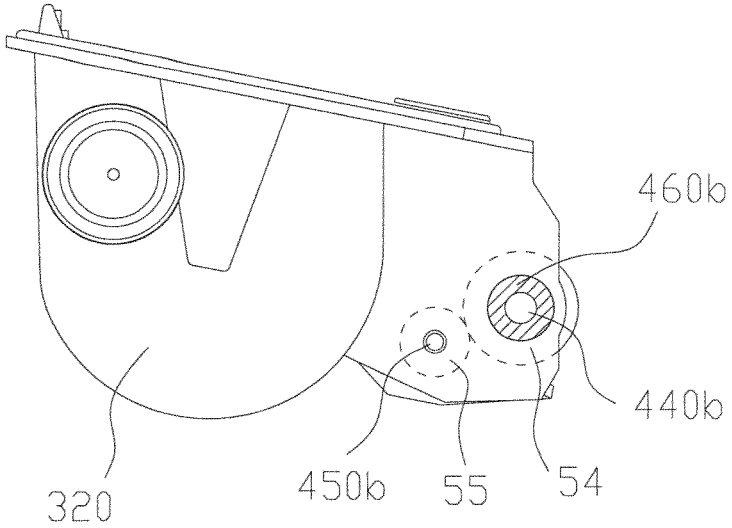

As shown in FIG. 19 and FIG. 20, in the present embodiment, the first side 310 of the separated toner cartridge is provided with a developing member supporting hole 440*a*, a toner feeding component supporting hole 450*a*, and a first elastic member 460*a*; the second side 320 of the separated toner cartridge is provided with a developing member supporting hole 440*b*, a toner feeding component supporting hole 450*b*, and a second elastic member 460*b*. The first elastic member 460*a* and the second elastic member 460*b* are located on the developing member supporting holes 440*a*, 440*b*, and support the two ends of the third embodiment of developing member 54; in the present embodiment, the first and the second elastic members 460*a*, 460*b* are made of elastic rubber materials, and can also be springs; the third embodiment of developing member 54 can slide on the developing member supporting holes 440*a*, 440*b* relative to the separated main part 300. The two ends of the toner feeding component 55 are supported by the toner feeding component supporting holes 450*a*, 450*b*; the toner feeding component 55 is fixed at the first side 310 and the second side 320 via the toner feeding component supporting holes 450*a*, 450*b*, which can not move freely relative to the separated main part 300.

As shown in FIG. 16, after the separated toner cartridge is mounted on the drum unit, the main part 300 of the separated toner cartridge is fixed to the main part 500 of the drum unit, which can not move freely; the first side 310 of the separated toner cartridge is located on the same side with the first side 510 of the drum unit, and the second side 320 of the separated toner cartridge is located on the same side with the second side 520 of the drum unit. The separated toner cartridge can not move freely when it is mounted on the drum unit, and the separated toner cartridge and the drum unit adopt contact developing mode, so, the third embodiment of developing member 54 and the third embodiment of photosensitive member 53 have interference fit between them; the third embodiment of developing member 54 can slide freely above the developing member supporting holes 440*a*, 440*b*, and the photosensitive member can not freely move, so, the third embodiment of developing member 54 has the trend to move away from the third embodiment of photosensitive member 53. At this moment, the first elastic member 460*a* and the second elastic member 460*b* apply elastic forces to the third embodiment of developing member 54, and the direction of the elastic forces is along the direction of the connection line of the axis of the third embodiment of photosensitive member 53 and the axis of the third embodiment of developing member 54, pointing to the third embodiment of photosensitive member 53; the elastic forces prevent the third embodiment of developing member 54 from moving away from the third embodiment of photosensitive member 53, so as to keep the interference fit between the third embodiment of developing member 54 and the third embodiment of photosensitive member 53, and the magnitude of interference between the third embodiment of photosensitive member 53 and the third embodiment of developing member 54 is adjusted by controlling the magnitude of the elastic forces.

Embodiment 4

The structure adopted in the present embodiment, except for the special explanation, is the same with the structure as shown in Embodiment 5.

Figure 23:
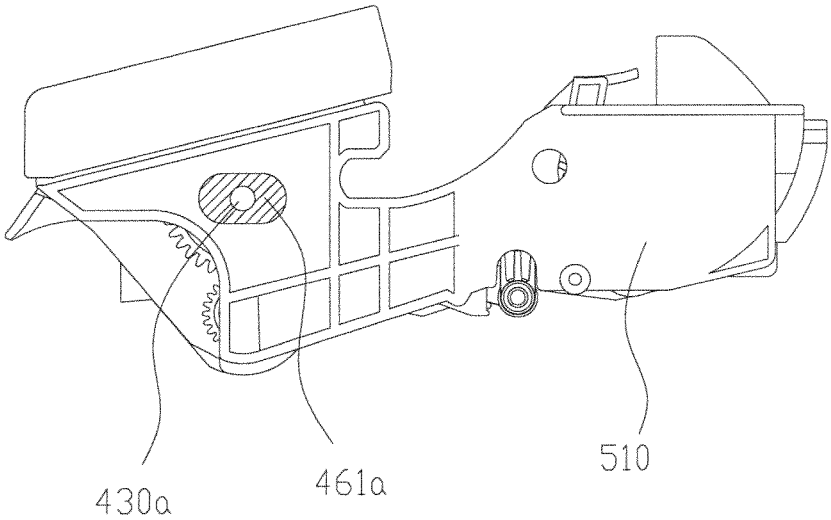
FIG. 23 and FIG. 24 are separately the left view and the right view of a drum unit of the fourth embodiment of the present invention.
Figure 24:
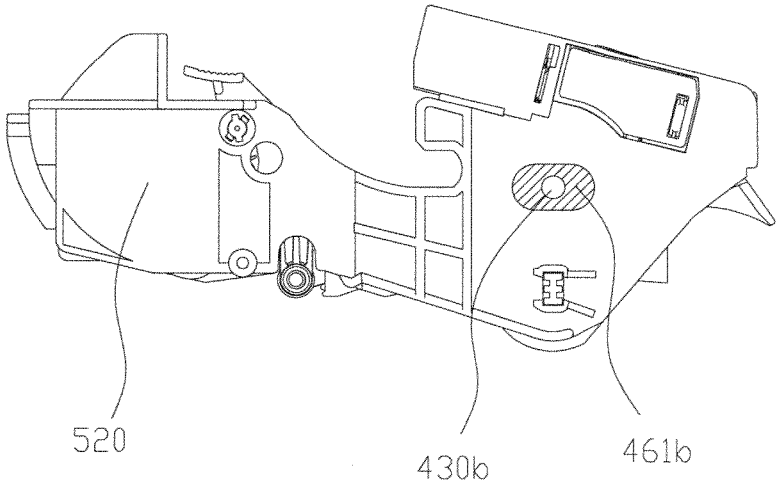

As shown in FIG. 23 and FIG. 24, the first side 510 of the drum unit is provided with a photosensitive member supporting hole 430*a* and a first elastic member 461*a*; the second side 520 of the drum unit is provided with a photosensitive member supporting hole 430*b* and a second elastic member 461*b*; the two ends of the third embodiment of photosensitive member 53 are respectively located on the photosensitive member supporting holes 430*a*, 430*b*, and are supported by the first and the second elastic members 461*a*, 461*b*; the two ends of the third embodiment of photosensitive member 53 can freely slide on the photosensitive member supporting holes 430*a*, 430*b*, and the first and the second elastic members 461*a*, 461*b* limit the third embodiment of photosensitive member 53 to slide freely.

As shown in FIG. 16, when the separated toner cartridge is mounted on the drum unit, the separated toner cartridge is fixed relative to the drum unit, and can not move freely; the third embodiment of developing member 54 of the separated toner cartridge and the third embodiment of photosensitive member 53 of the drum unit have interference fit between them; for the third embodiment of photosensitive member 53 can slide freely, the third embodiment of photosensitive member 53 has the trend to move away from the third embodiment of developing member 54; the first and the second elastic members 461*a*, 461*b* support the third embodiment of photosensitive member 53, and provide elastic forces to the third embodiment of photosensitive member 53; the direction of the elastic forces is along the direction of the connection line of the axis of the third embodiment of photosensitive member 53 and the axis of the third embodiment of developing member 54, pointing to the third embodiment of developing member 54; the elastic forces prevent the third embodiment of photosensitive member 53 from moving away, so as to keep the third embodiment of photosensitive member 53 closely contacting with the third embodiment of developing member 54; the magnitude of interference between the third embodiment of photosensitive member 53 and the third embodiment of developing member 54 is adjusted by controlling the magnitude of the elastic forces. The first and the second elastic members 461*a*, 461*b* are one kind of elastic rubbers or springs.

Embodiment 5

The structure adopted in the present embodiment, except for the special explanation, is the same with the structure as shown in Embodiment 3.

Figure 25:
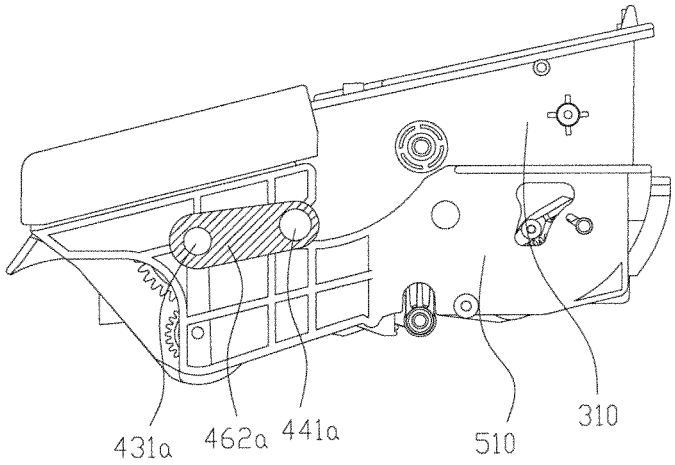
FIG. 25 is a left view of a toner cartridge of the fifth embodiment of the present invention.

As shown in FIG. 25, the first side 510 of the drum unit is provided with a photosensitive member supporting hole 431*a*; the first side 310 of the separated toner cartridge is provided with a developing member supporting hole 441*a*; a first elastic member 462*a* is located between the photosensitive member supporting hole 431*a* and the developing member supporting hole 441*a*. One end of the third embodiment of photosensitive member 53 is located on the photosensitive member supporting hole 431*a*, and one end of the third embodiment of developing member 54 is located on the developing member supporting hole 441*a*; the first elastic member 462*a* applies an elastic force to the third embodiment of photosensitive member 53 via the photosensitive member supporting hole 431*a*, and the direction of the elastic force is along the direction of the connection line of the axis of the third embodiment of photosensitive member 53 and the axis of the third embodiment of developing member 54, pointing to the third embodiment of developing member 54; the first elastic member 462*a* applies an elastic force to the third embodiment of developing member 54 via the developing member supporting hole 441*a*, and the direction of the elastic force is along the direction of the connection line of the axis of the third embodiment of photosensitive member 53 and the axis of the third embodiment of developing member 54, pointing to the third embodiment of photosensitive member 53; the elastic forces make the third embodiment of photosensitive member 53 to closely contact with the third embodiment of developing member 54.

In the same way, the second side 320 of the of the separated toner cartridge and the second side 520 of the drum unit are correspondingly provided with a photosensitive member supporting hole, a developing member supporting hole, and a second elastic member. The first and the second elastic members are one kind of elastic rubbers or springs.

Selectively, in the present embodiment, one end of the first and the second elastic members is fixed to the drum unit, and the other end is separately connected to one end of the developing member; the separated toner cartridge is fixed to the main part of the drum unit, and is immovable relative to the drum unit; the photosensitive member is fixed to the drum unit; the developing member can move relative to the main part of the separated toner cartridge; when the separated toner cartridge is mounted on the drum unit, the developing member moves towards the photosensitive member by the action of the elastic forces provided by the first and the second elastic members.

Selectively, in the present embodiment, one end of the of the first and the second elastic members is fixed to the separated toner cartridge, and the other end is separately connected to one end of the photosensitive member; the separated toner cartridge is fixed to the main part of the drum unit, and is immovable relative to the drum unit; the developing member is fixed to the separated toner cartridge to be immovable, and the photosensitive member can freely slide in the drum unit; the photosensitive member moves towards the developing member by the action of the elastic forces provided by the first and the second elastic members.

Embodiment 6

The structure of the process cartridge adopted in the present embodiment, except for the special explanation, is the same with the structure as shown in FIG. 5.

Figure 26:
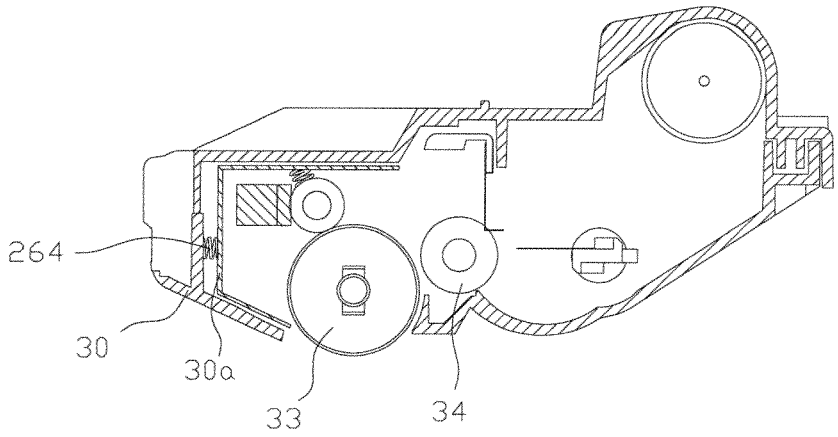
FIG. 26 illustrates a toner cartridge of the sixth embodiment of the present invention.

As shown in FIG. 26, the process cartridge comprises a main part 30, a second embodiment of photosensitive member 33, and the second embodiment of developing member 34; the process cartridge also comprises a photosensitive member frame 30*a* and an elastic member 264.

The photosensitive member frame 30*a* is at least provided with the second embodiment of photosensitive member 33, and it can also be provided with other components, such as a charge member for charging the photosensitive member, and a cleaning component for cleaning the photosensitive member. The photosensitive member frame 30*a* is located in the main part 30, and can move relative to the main part 30; the second embodiment of photosensitive member 33 is fixed to the photosensitive member frame 30*a*, so, the second embodiment of photosensitive member 33 can move relative to the main part 30. The elastic member 264 is located between the main part 30 and the photosensitive member frame 30*a*, to provide an elastic force to the photosensitive member frame 30*a*; so, the second embodiment of photosensitive member 33 is made capable of moving relative to the main part 30 together with the photosensitive member frame 30*a*. The second embodiment of developing member 34 is located at the main part 30, and can not move relative to the main part 30; so, by the action of the elastic force provided by the elastic member 264, the second embodiment of photosensitive member 33 moves relative to the second embodiment of developing member 34 together with the photosensitive member frame 30*a*, and the distance between the second embodiment of photosensitive member 33 and the second embodiment of developing member 34 is adjusted by elasticity.

Embodiment 7

The structure of the toner cartridge adopted in the present embodiment, except for the special explanation, is the same with the structure of the toner cartridge as shown in Embodiment 3.

Figure 27:
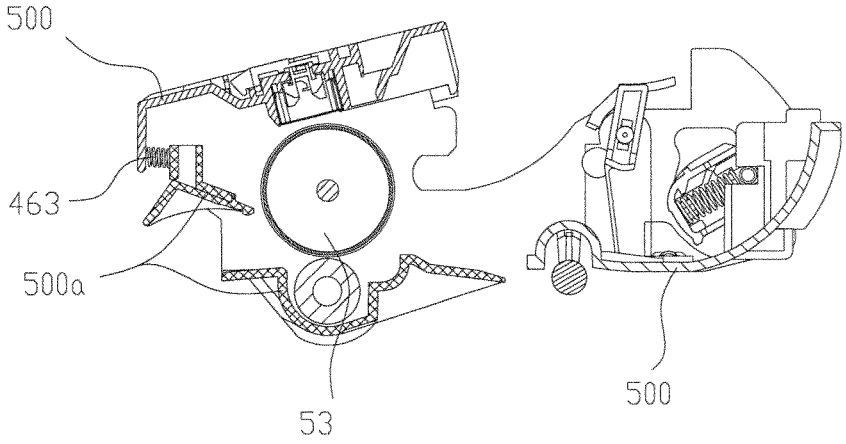
FIG. 27 illustrates a toner cartridge of the seventh embodiment of the present invention.

As shown in FIG. 27, the drum unit comprises a main part 500 of the drum unit, and a third embodiment of photosensitive member 53; it also comprises a photosensitive member frame 500*a* and an elastic member 463.

The photosensitive member frame 500*a* is at least provided with the third embodiment of photosensitive member 53, and also can be provided with other components, such as a transfer member, and a charge member for charging the photosensitive member. The third embodiment of photosensitive member 53 is fixed to the photosensitive member frame 500*a*; the photosensitive member frame 500*a* is located in the main part 500, and can be movable in the main part 500; so, the third embodiment of photosensitive member 53 fixed to the photosensitive member frame 500*a* can move relative to the main part 500. An elastic member 463 is provided between the photosensitive member frame 500*a* and the main part 500.

When the separated toner cartridge provided with a developing member is mounted on the drum unit, the elastic member 463 is pressed, and provides an elastic force to the photosensitive member frame 500*a*; so, the third embodiment of photosensitive member 53 is made to move towards the developing member, and the distance between the third embodiment of photosensitive member 53 and the developing member is adjusted by elasticity.

Although the present invention has been described in detail with above said embodiments, but it is not to limit the scope of the invention. So, all the modifications and changes according to the characteristic and spirit of the present invention, are involved in the protected scope of the invention.

What is claimed is:

1. A method for controlling a distance between a photosensitive member and a developing member in a process cartridge, the method comprising:

providing elastic members that provide an elastic force to the photosensitive member along a straight line between the photosensitive member and the developing member and mounting the elastic member in the process cartridge, so as to force the photosensitive member to move towards the developing member along the straight line of a moving trajectory of the developing members and the photosensitive members.

2. The method of claim 1, comprising mounting the elastic members on a main part, a first lateral plate, or a second lateral plate of the process cartridge, wherein the photosensitive member is movable relative to the main part.

3. The method of claim 1, wherein the elastic members are mounted on the main part to provide the elastic force via a photosensitive member frame.

4. A device for controlling a distance between a photosensitive member and a developing member in a process cartridge comprising:

a main part, a photosensitive member, a developing member, a first and a second lateral plate, the first and the second lateral plates are located at two opposite sides of the main part to support the developing member, including photosensitive member fixing positions, the photosensitive member is fixed to the first lateral plate and the second lateral plate via the photosensitive member fixing positions, a first and a second supporting component are respectively provided on the first and second lateral plates to support the end of the developing member, the first and second supporting components can freely slide on the first and second lateral plates, and elastic members are mounted on the first lateral plate and the second lateral plate to provide an elastic force to opposite ends of the developing member to force the developing member to move towards the photosensitive member by applying elastic forces to the first and second supporting components.

5. A device for controlling a distance between a photosensitive member and a developing member in a process cartridge comprising elastic members providing an elastic force to the photosensitive member along a straight line between the photosensitive member and the developing member, so as to force the photosensitive member to move towards the developing member along the straight line of a moving trajectory of the developing member and the photosensitive member.

6. The device of claim 5, further comprising:

a main part, a first lateral plate, and a second lateral plate; wherein the first and the second lateral plates are located at two opposite sides of the main part to support the photosensitive member, and wherein the photosensitive member is movable relative to the main part; and wherein the elastic members are mounted on the main part, the first lateral plate, or the second lateral plate.

7. The device of claim 5, further comprising a photosensitive member frame; wherein the photosensitive member frame supports the photosensitive member; and wherein the photosensitive member frame is movable relative to the main part; and wherein the elastic members provide the elastic force to the photosensitive member via the photosensitive member frame.

8. A device for controlling a distance between a photosensitive member and a developing member in a separated toner cartridge being used together with a drum unit, the separated toner cartridge including a separated main part of the separated toner cartridge, a first side of the separated toner cartridge, a second side of the separated toner cartridge, a developing member, the developing member being supported on the first side and the second side of the separated toner cartridge, and an elastic member arranged at each opposite end of the developing member and configured to provide an elastic force to the developing member along a straight line between the photosensitive member and the developing member, so as to force the developing member to move towards a photosensitive member of the drum unit along the straight line of a moving trajectory of the developing member and the photosensitive member.

9. The device of claim 8, wherein the developing member is movable relative to the separated main part; and wherein the elastic members are mounted on the main part, the first side, or the second side.

10. A device for controlling a distance between a photosensitive member and a developing member in a separated toner cartridge comprising a drum unit being used together with the separated toner cartridge, the drum unit including a drum unit main part, a first side of the drum unit, a second side of the drum unit, a photosensitive member, the photosensitive member being supported on the first side and the second side of the drum unit and an elastic member arranged at each opposite end of the photosensitive member and configured to provide an elastic force to the photosensitive member along a line between the photosensitive member and the developing member, so as to force the photosensitive member to move towards a developing member of the separated toner cartridge.

11. The device of claim 10, wherein the photosensitive member is movable relative to the drum unit main part; and wherein the elastic members are mounted on the main part, the first side, or the second side.

12. The device of claim 10, further comprising a photosensitive member frame; wherein the photosensitive member frame is configured to support the photosensitive member; and wherein the photosensitive member frame is movable relative to the drum unit main part; and wherein the elastic members provide the elastic force to the photosensitive member via the photosensitive member frame.

* * * * *